US010520880B2

(12) United States Patent
Okauchi

(10) Patent No.: US 10,520,880 B2
(45) Date of Patent: Dec. 31, 2019

(54) IMAGE FORMING APPARATUS ENABLING ANGLE ADJUSTMENT OF FIXING UNIT TO APPARATUS MAIN BODY

(71) Applicant: KYOCERA Document Solutions Inc., Osaka (JP)

(72) Inventor: Yoshifumi Okauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/371,277

(22) Filed: Apr. 1, 2019

(65) Prior Publication Data

US 2019/0302680 A1 Oct. 3, 2019

(30) Foreign Application Priority Data

Apr. 2, 2018 (JP) ..... 2018-070991

(51) Int. Cl.
*G03G 15/20* (2006.01)
*G03G 21/16* (2006.01)

(52) U.S. Cl.
CPC ..... *G03G 21/1652* (2013.01); *G03G 21/1685* (2013.01)

(58) Field of Classification Search
CPC ..... G03G 21/1652; G03G 21/1685
USPC ..... 399/90, 122
See application file for complete search history.

(56) References Cited

U.S. PATENT DOCUMENTS

| | | | | |
|---|---|---|---|---|
| 8,861,857 | B2 | 10/2014 | Urashima | |
| 9,804,555 | B2 * | 10/2017 | Yoshida et al. | G03G 21/1685 |
| 9,939,777 | B2 * | 4/2018 | Kamiya et al. | G03G 21/1652 |
| 10,254,688 | B2 * | 4/2019 | Ishii | G03G 21/1685 |

FOREIGN PATENT DOCUMENTS

JP 2010-021656 A 1/2010

* cited by examiner

*Primary Examiner* — William J Royer
(74) *Attorney, Agent, or Firm* — Studebake & Brackett PC

(57) ABSTRACT

An image forming apparatus includes a fixing unit and an apparatus main body. The fixing unit fixes a toner image on a sheet while conveying the sheet. In the apparatus main body, the fixing unit is removably attached. The fixing unit includes a unit side connection part. The apparatus main body includes a main body side connection part and a first adjustment mechanism. The main body side connection part is electrically connected with the unit side connection part. The first adjustment mechanism is used for adjusting an angle of the fixing unit with respect to the apparatus main body. The main body side connection part is arranged at a side of a supporting point of angle adjustment of the fixing unit by the first adjustment mechanism.

8 Claims, 10 Drawing Sheets

IMAGE FORMING APPARATUS ENABLING ANGLE ADJUSTMENT OF FIXING UNIT TO APPARATUS MAIN BODY

INCORPORATION BY REFERENCE

This application is based on and claims the benefit of priority from Japanese Patent application No. 2018-070991 filed on Apr. 2, 2018, the entire contents of which are incorporated herein by reference.

BACKGROUND

The present disclosure relates to an image forming apparatus.

In an image forming apparatus, due to precision degradation of parallelism in conveying roller axes composing sheet conveyance system, problems of conveyance property may occur. For example, in an intermediate transferring type image forming apparatus, precision degradation of alignment between a secondary transferring device and a fixing device causes not only problems of sheet conveyance property, but also a defective image. Concretely, if the alignment between the secondary transferring device and the fixing device is shifted, as soon as a sheet enters into a fixing nip of the fixing device through the secondary transferring device, the sheet is affected by strong conveyance force of the fixing device, and thereby, the image transferred on the sheet is distorted in a secondary transferring part. Therefore, it is necessary that the alignment between the secondary transferring device and the fixing device, particularly, parallelism a pair of rollers of the secondary transferring part and a pair of rollers of the fixing device is maintained in high precision.

Thereupon, an image forming apparatus being able to adjust the alignment between the secondary transferring device and the fixing device is proposed. For example, in a conventional image forming apparatus, it is possible to adjust an angle of a fixing unit including a fixing roller and a pressuring roller to the secondary transferring device and to adjust a position of an electrical connection part at a main body side of the image forming apparatus so as to match to a position of an electrical connection part at a side of the fixing unit after angle adjustment.

However, in the conventional image forming apparatus, the electrical connection parts of the fixing unit and a main body of the image forming apparatus are arranged at an opposite side to a side of a supporting point of angle adjustment of the fixing unit. Therefore, by the angle adjustment of the fixing unit, the position of the electrical connection part at a side of the fixing unit is greatly varied. As a result, there are problems that position adjustment of the electrical connection part at the main body side of an image forming apparatus becomes a large scale and adjustment work becomes complicated.

SUMMARY

In accordance with the present disclosure, an image forming apparatus includes a fixing unit and an apparatus main body. The fixing unit fixes a toner image on a sheet while conveying the sheet. In the apparatus main body, the fixing unit is removably attached. The fixing unit includes a unit side connection part. The apparatus main body includes a main body side connection part and a first adjustment mechanism. The main body side connection part is electrically connected with the unit side connection part. The first adjustment mechanism is used for adjusting an angle of the fixing unit with respect to the apparatus main body. The main body side connection part is arranged at a side of a supporting point of angle adjustment of the fixing unit by the first adjustment mechanism.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, an image forming apparatus 1 according to an embodiment of the present disclosure will be described. Arrows Fr, Rr, L, R, U and Lo appropriately put on each of the drawings respectively indicate a front side, a rear side, a left side, a right side, an upper side and a lower side of the image forming apparatus 1.

First, entire structure of the image forming apparatus 1 will be described. The image forming apparatus 1 is, for example, a multifunction peripheral having a print function, a copy function, a facsimile function and others in combination.

Figure 1:
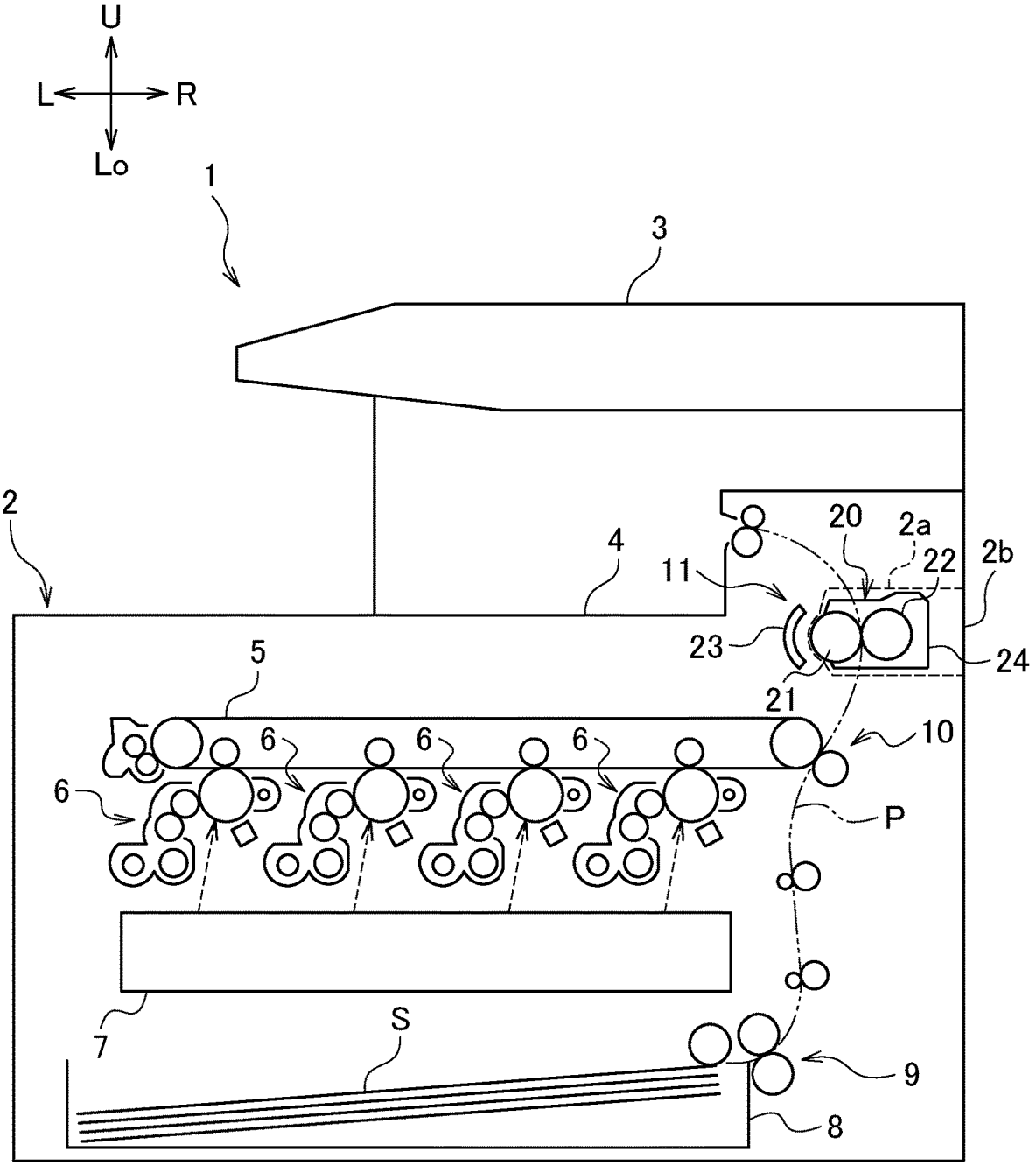
FIG. 1 is a sectional view schematically showing an image forming apparatus according to an embodiment of the present disclosure.

As shown in FIG. 1, the image forming apparatus 1 includes a box-shaped apparatus main body 2. In an upper end of the apparatus main body 2, an image reading device 3 reading an image of a document is provided. In an upper part of the apparatus main body 2, an ejected sheet tray 4 is provided. In a roughly center part of the apparatus main body 2, an intermediate transfer belt 5 and four image forming parts 6 are housed. The four image forming parts 6 are configured to respectively correspond to toners of black, cyan, magenta and yellow. In a lower part of the apparatus main body 2, an exposure device 7 is housed. In a lower end of the apparatus main body 2, a sheet feeding cartridge 8 storing sheets S is housed.

At a right part in the apparatus main body 2, a conveyance path P for the sheet S is provided. At an upstream end of the conveyance path P, a sheet feeding part 9 is provided. At a middle stream part of the conveyance path P, a secondary transferring part 10 is provided. At a downstream part of the conveyance path P, a fixing device 11 is provided. In the vicinity of the upper end of the right part in the apparatus main body 2, a unit housing chamber 2*a* housing a fixing unit 20 composing the greater part of the fixing device 11 is provided. The fixing unit 20 is removably attached into the unit housing chamber 2*a* from an attachment port 2*b* formed in a right face of the apparatus main body 2.

Next, an operation of the image forming apparatus 1 will be described.

First, by light (refer to a two-dot chain lined arrow in FIG. 1) from the exposure device 7, an electrostatic latent image is formed in each image forming part 6. The electrostatic latent image is developed to a toner image in each image forming part 6. This toner image is primarily transferred from each image forming part 6 to the intermediate transfer belt 5. Thereby, a full color toner image is formed on the intermediate transfer belt 5.

Moreover, the sheet S picked up from the sheet feeding cartridge 8 by the sheet feeding part 9 is conveyed to a downstream side on the conveyance path P to enter into the secondary transferring part 10. In this secondary transferring part 10, the full color toner image formed on the intermediate transfer belt 5 is secondarily transferred on the sheet S. The sheet S having the secondarily transferred toner image is conveyed to a further downstream side on the conveyance path P to enter into the fixing device 11. In this fixing device 11, the toner image is fixed to the sheet S. The sheet S having the fixed toner image is ejected to the ejected sheet tray 4.

Next, structure of the fixing device 11 will be further described. Incidentally, an arrow A indicates a conveying direction of the sheet S.

Figure 2:
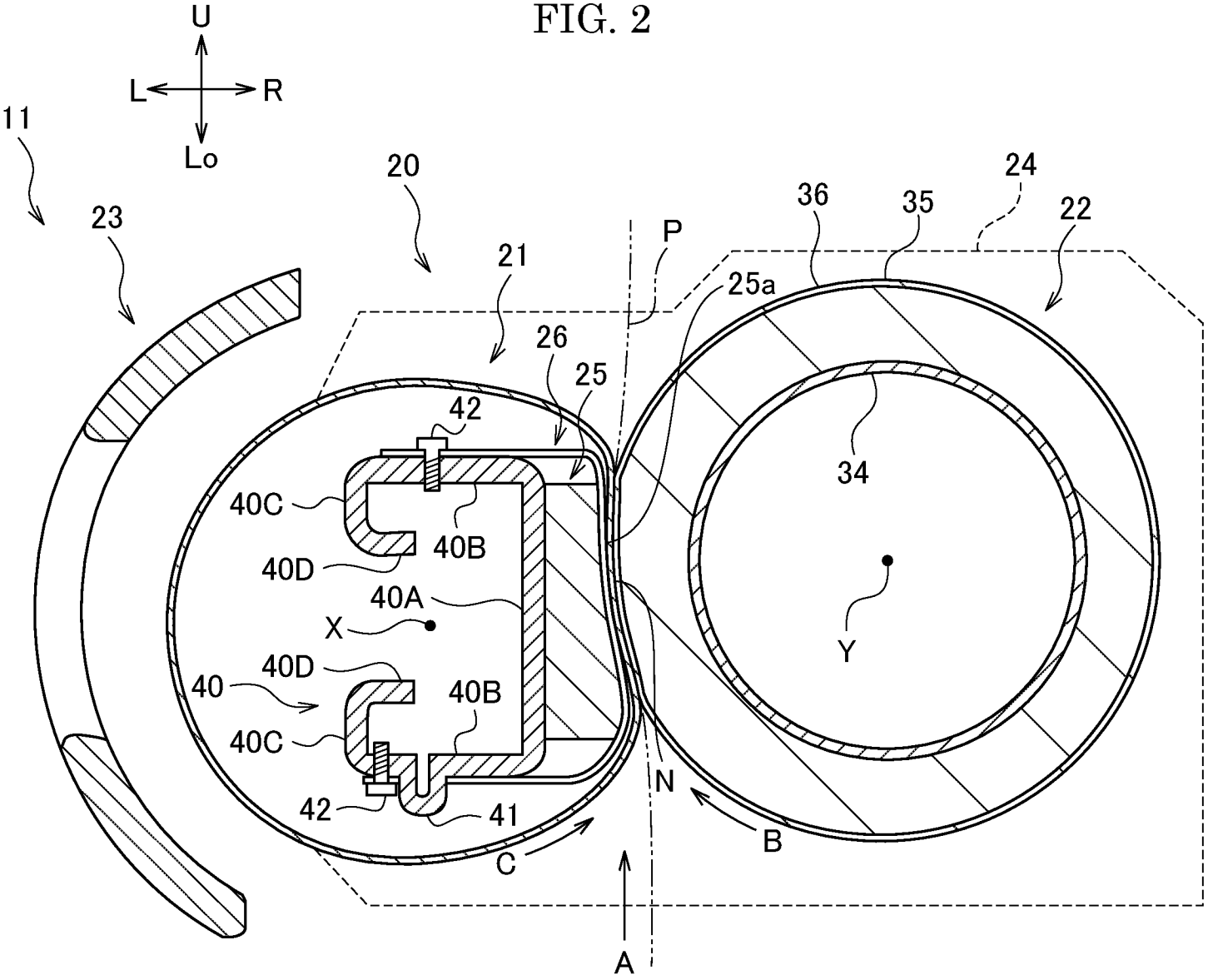
FIG. 2 is a sectional view showing a fixing device of the image forming apparatus shown in FIG. 1.

As shown in FIG. 2, the fixing device 11 includes a fixing belt 21, a pressuring roller 22 arranged at a right side of the fixing belt 21, and a heater 23 arranged at a left side of the fixing belt 21. The fixing belt 21 and the pressuring roller 22 are housed in a unit casing 24 of the fixing unit 20.

The fixing belt 21 is formed in a cylindrical shape elongated in forward and backward directions. The fixing belt 21 has elasticity and is endless in its circumference direction. The fixing belt 21 is arranged to be rotated around an axis X extended in the forward and backward directions. Inside the fixing belt 21, a supporting member 40, a nip member 25 and a sliding sheet 26 are provided.

The fixing belt 21 includes, for example, a base layer, an elastic layer provided around the base layer, and a release layer covering the elastic layer. The base layer of the fixing belt 21 is made of, for example, metal, such as nickel, or resin, such as polyimide. The elastic layer of the fixing belt 21 is made of, for example, elastic material, such as silicone rubber. The release layer of the fixing belt 21 is made of, for example, fluorine resin, such as PFA (Per Fluoro Alkoxy).

The pressuring roller 22 is formed in a cylindrical shape elongated in the forward and backward directions. The pressuring roller 22 is arranged to be rotated around an axis Y extended in the forward and backward directions. The pressuring roller 22 comes into contact with the fixing belt 21 by predetermined pressure to form a fixing nip N with the fixing belt 21.

The pressuring roller 22 includes, for example, a cylindrical core material 34, an elastic layer 35 provided around the core material 34, a release layer 36 covering the elastic layer 35, and a unit side drive gear 38 (refer to FIG. 4) fixedly attached to a rear end of the core material 34. The core material 34 is made of, for example, metal, such as stainless steel or aluminum. The elastic layer 35 is made of, for example, elastic material, such as silicone rubber. The release layer 36 is made of, for example, fluorine resin, such as PFA.

The heater 23 is arranged at an opposite side to the fixing nip N across the axis X of the fixing belt 21. The heater 23 is arranged with an arc-shape along an outer circumference face of the fixing belt 21.

The supporting member 40 is formed by bending one plate metal. The supporting member 40 includes a main wall portion 40A extended in upward and downward directions, first bent portions 40B bent from both upper and lower ends of the main wall portion 40A to a left side (a side separating from the fixing nip N), second bent portions 40C bent from left ends of the respective first bent portions 40B to the inside in the upward and downward directions, and third bent portions 40D bent from inside ends in the upward and downward directions of the respective second bent portions 40C to a right side. On an outer face of the first bent portion 40B positioned at upstream side in a rotating direction of the fixing belt 21, a protrusion portion 41 used for positioning the sliding sheet 26 is provided.

The nip member 25 is made of, for example, heat resistant resin, such as LCP (Liquid Crystal Polymer). A left face (an inner face) of the nip member 25 is fixedly attached to the main wall portion 40A of the supporting member 40. Thereby, the nip member 25 is supported by the supporting member 40. The nip member 25 has an opposing face 25*a* opposing to the pressuring roller 22 via the fixing belt 21. The opposing face 25*a* of the nip member 25 presses the fixing belt 21 via the sliding sheet 26 to a side of the pressuring roller 22.

The fixing belt 21 and the pressuring roller 22 come into pressure contact with each other by pressuring both ends of the supporting member 40 and both ends of the pressuring roller 22 by a pressuring mechanism (not shown).

The sliding sheet 26 is a thin and soft member made of, fluorine resin, such as PTFE (Poly Tetra Fluoro Ethylene). A friction coefficient between the sliding sheet 26 and the fixing belt 21 is smaller than a friction coefficient between the nip member 25 and the fixing belt 21. On the sliding sheet 26, lubricating oil (lubricant) is applied.

In the sliding sheet 26, a positioning hole is provided in the vicinity of an end of the sliding sheet 26 at an upstream side in the rotating direction of the fixing belt 21. Into the positioning hole of the sliding sheet 26, the protrusion portion 41 of the supporting member 40 is fitted, and further, ends of the sliding sheet 26 in the vicinity of at the upstream side and a downstream side in the rotating direction of the fixing belt 21 are fixedly attached to the supporting member 40 by fastening screws.

In the fixing device 11 configured as described above, when the toner image is fixed to the sheet S, the pressuring roller 22 is rotated (refer to an arrow B in FIG. 2). According to this, by friction force between the pressuring roller 22 and the fixing belt 21, the fixing belt 21 is rotated by following rotation of the pressuring roller 22 (refer to an arrow C in FIG. 2). Moreover, when the toner image is fixed to the sheet S, the heater 23 heats the fixing belt 21. In such a situation, when the sheet S passes through the fixing nip N, the sheet S and the toner image are heated and pressured, and thereby, the toner image is fixed to the sheet S.

Figure 3:
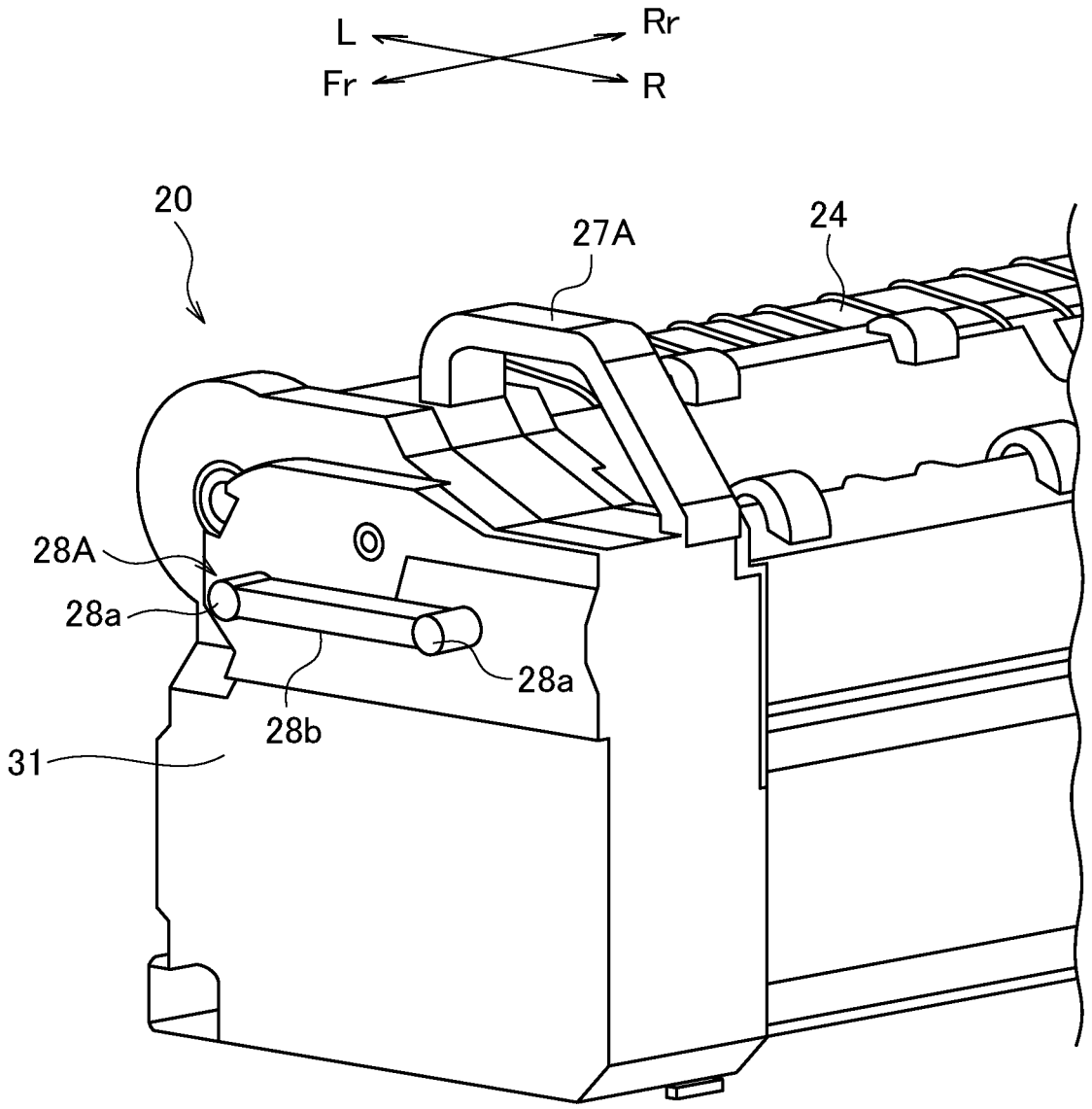
FIG. 3 is a perspective view showing a front part of the fixing device shown in FIG. 1.
Figure 4:
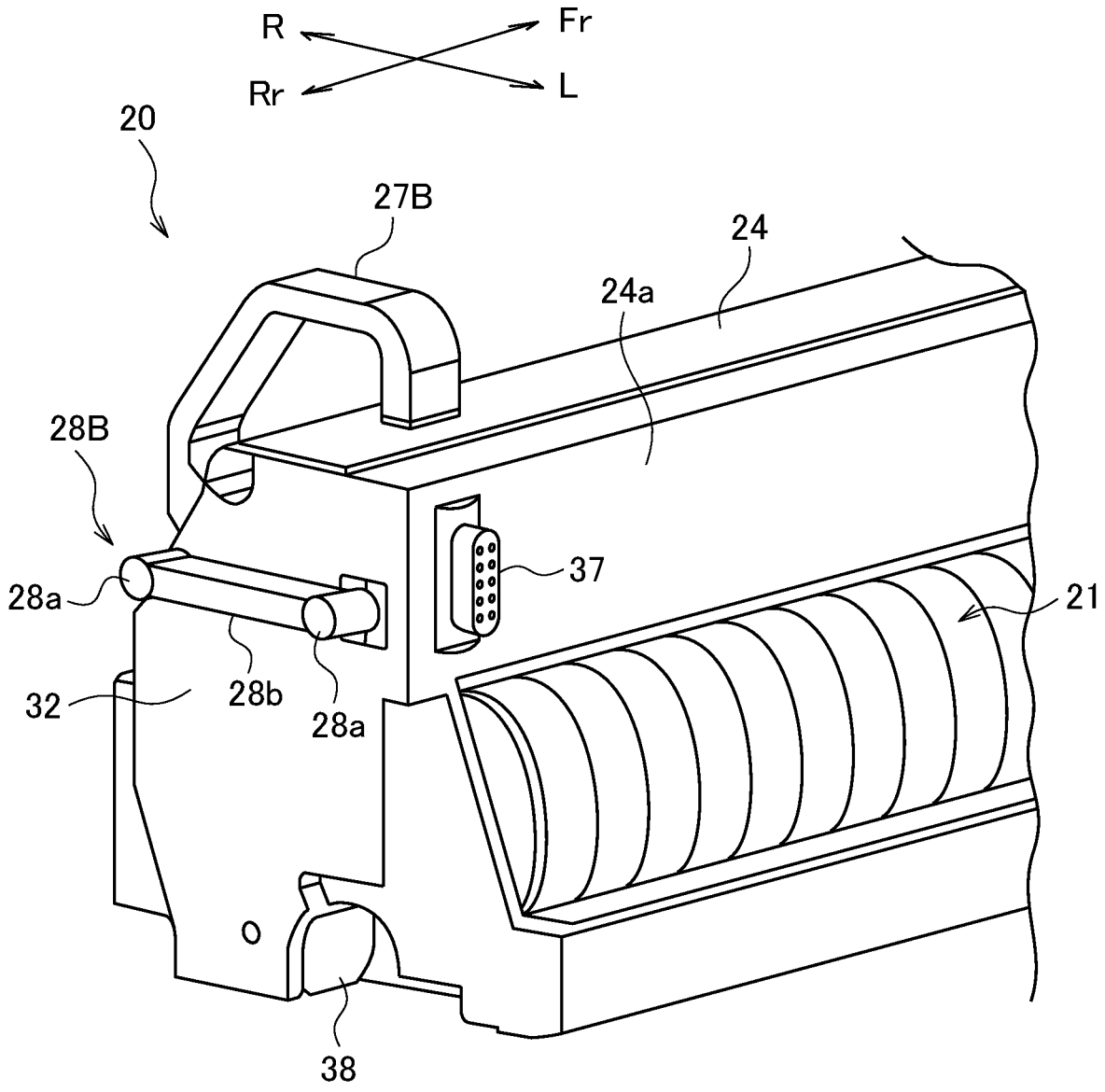
FIG. 4 is a perspective view showing a rear part of the fixing device shown in FIG. 1.

As shown in FIGS. 3 and 4, at both sides portion in a longitudinal direction of the unit casing 24, a pair of handle parts 27A, 27B held by hands when the fixing unit 20 is attached to/removed from the apparatus main body 2 and a pair of guide protrusion parts 28A, 28B guiding the fixing unit 20 are provided. The handle parts 27A, 27B are arranged in an upper end of the unit casing 20. The guide protrusion parts 28A, 28B are arranged in front and rear end plates parts 31, 32 of the unit casing 20 and protruded in the forward and backward directions, respectively. The guide protrusion parts 28A, 28B include a pair of respective left and right columnar portions 28*a*, and a connecting portion 28*b* straightly connecting the left and right columnar portions 28*a*.

As shown in FIG. 4, in a rear end of the fixing unit 20, a unit side drawer terminal 37 (a unit side connection part) outputting an electric signal used for detecting a rotation state and others of the pressuring roller 22, and the unit side drive gear 38 transmitting power to a rotating shaft of the pressuring roller 22 are provided. In this example, the unit side drawer terminal 37 is arranged in a left face 24*a* of the unit casing 24. Moreover, the unit side drive gear 38 is arranged in a lower end of the fixing unit 20.

Figure 5:
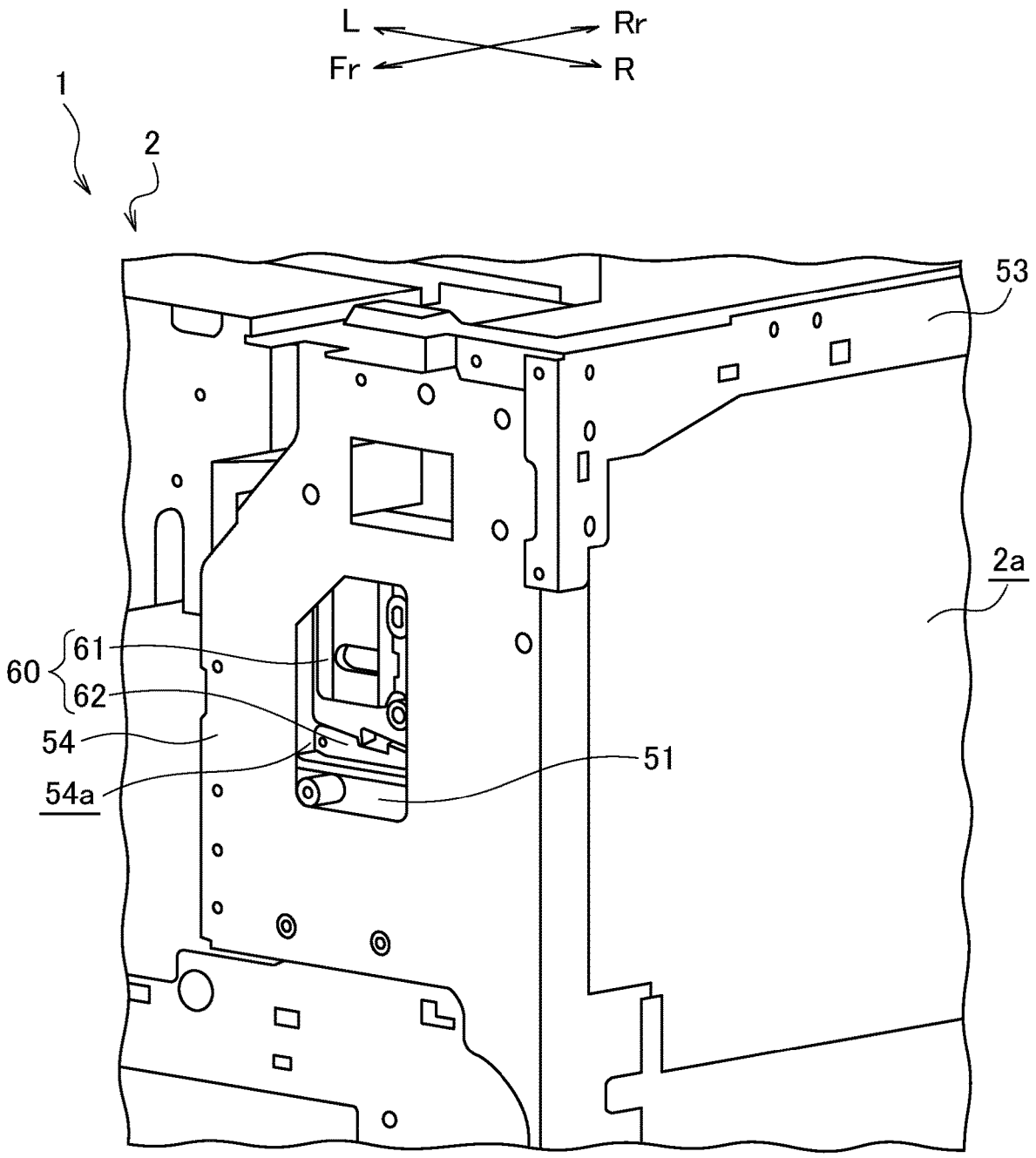
FIG. 5 is a partly perspective view showing a front part of an apparatus body of the image forming apparatus shown in FIG. 1.
Figure 6:
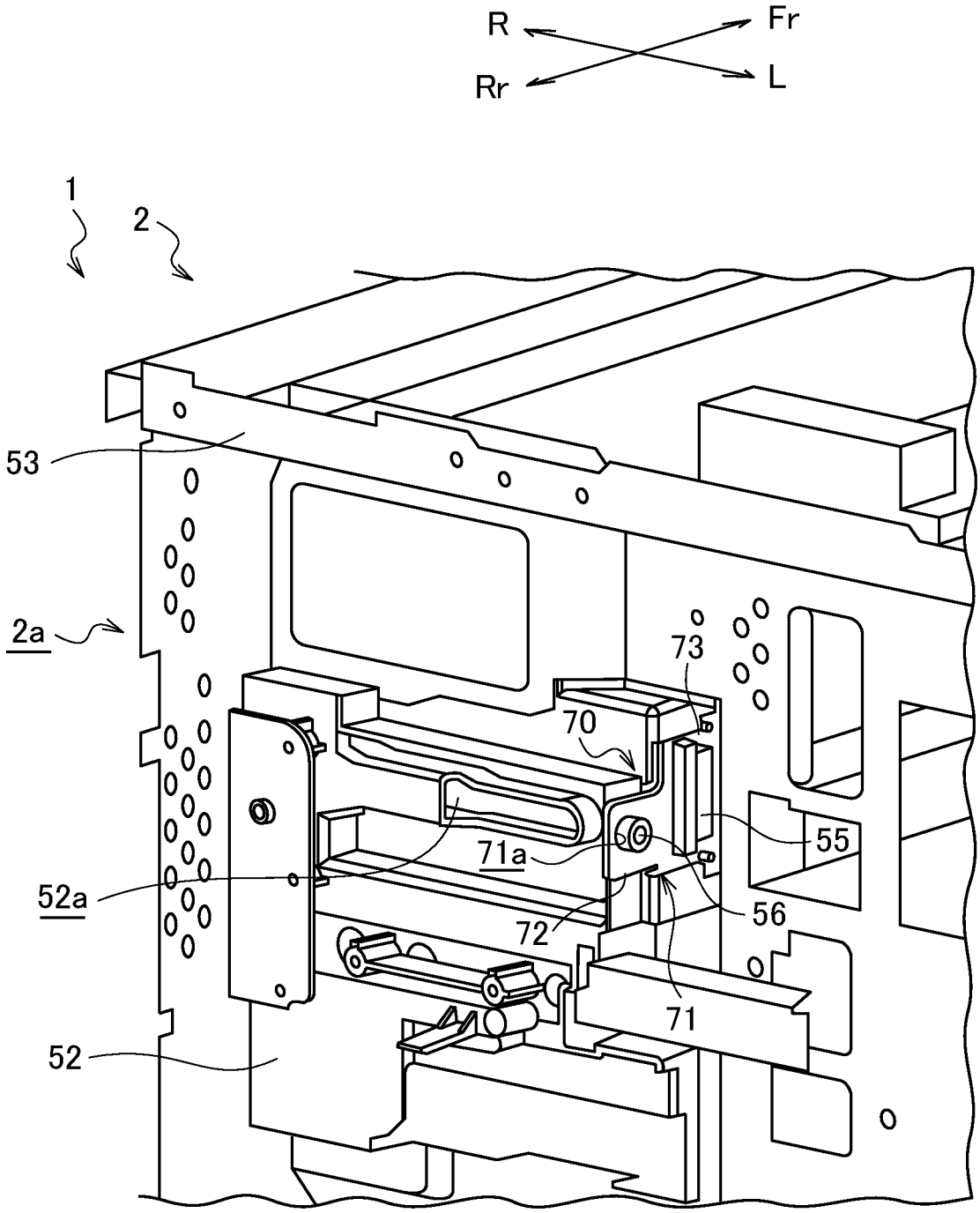
FIG. 6 is a partly perspective view showing a rear part of the apparatus body of the image forming apparatus shown in FIG. 1.

As shown in FIGS. 5 and 6, in front and rear ends of the unit housing chamber 2*a* of the apparatus main body 2, a pair of front and rear supporting plates 51 and 52 supporting the fixing unit 20 are provided. Both supporting plates 51 and 52 are fixedly attached to a structure body 53 of the apparatus main body 2. The outside (a front side) of the front supporting plate 51 is covered by a covering plate 54. In the covering plate 54, an operation window 54*a* is provided.

Figure 7:
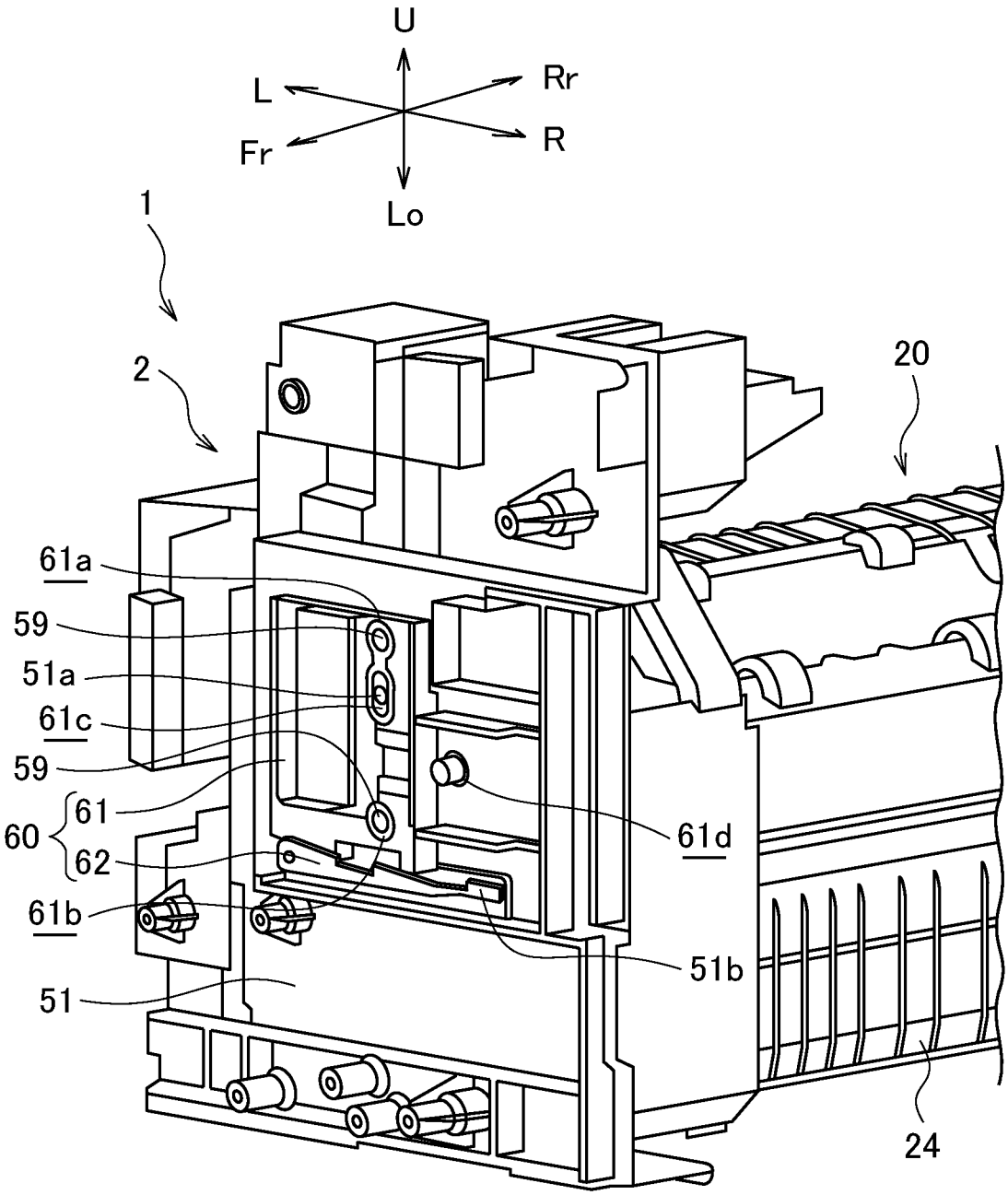
FIG. 7 is a partly perspective view showing a first adjustment mechanism and its peripherals of the image forming apparatus shown in FIG. 1.

As shown in FIGS. 5 and 7, in the front supporting plate 51, a first adjustment mechanism 60 used for adjusting an angle of the fixing unit 20 is provided. The first adjustment mechanism 60 includes a holding member 61 holding the front guide protrusion part 28A (an opposite end to a side of a supporting point of angle adjustment of the fixing unit 20) (refer to FIG. 3) of the fixing unit 20 and being movable in the conveying direction of the sheet S (the upward and downward directions in this example) and an adjusting member 62 used for adjusting a movement position of the holding member 61.

In the vicinity of upper and lower ends at a right side in the holding member 61, a pair of screw through holes 61*a*, 61*b* elongated in the upward and downward directions are provided. In the vicinity of a lower side of the upper screw through hole 61*a*, a guide hole 61*c* elongated in the upward and downward directions is provided in the holding member 61. In the front supporting plate 51, a pair of screw holes (not shown) respectively communicating with the screw through holes 61*a*, 61*b*, and a protrusion 51*a* inserting into the guide hole 61*c* are provided. In a back face side (a rear face) of the holding member 61, a guide gap portion 61*d* receiving and holding the front guide protrusion part 28A (refer to FIG. 3) of the fixing unit 20 is provided. The guide gap portion 61*d* is extended in left and right directions.

The holding member 61 is movable in the upper and downward directions between a position when the protrusion 51*a* of the front supporting plate 51 comes into contact with an upper end of the guide hole 61*c* and a position when the protrusion 51*a* comes into contact with a lower end of the guide hole 61*c*. The holding member 61 is fixedly attached to the front supporting plate 51 by inserting screws 59 into the screw through holes 61*a*, 61*b* and fastening the screws 59 to screw holes (not shown) of the supporting plate 51.

The adjusting member 62 is arranged below the holding member 61. The adjusting member 62 is movable in the left and right directions along a guide slit 51*b* provided in the front supporting plate 51. Operation of moving the adjusting member 62 can be carried out via the operation window 54*a* of the covering plate 54.

Figure 8:
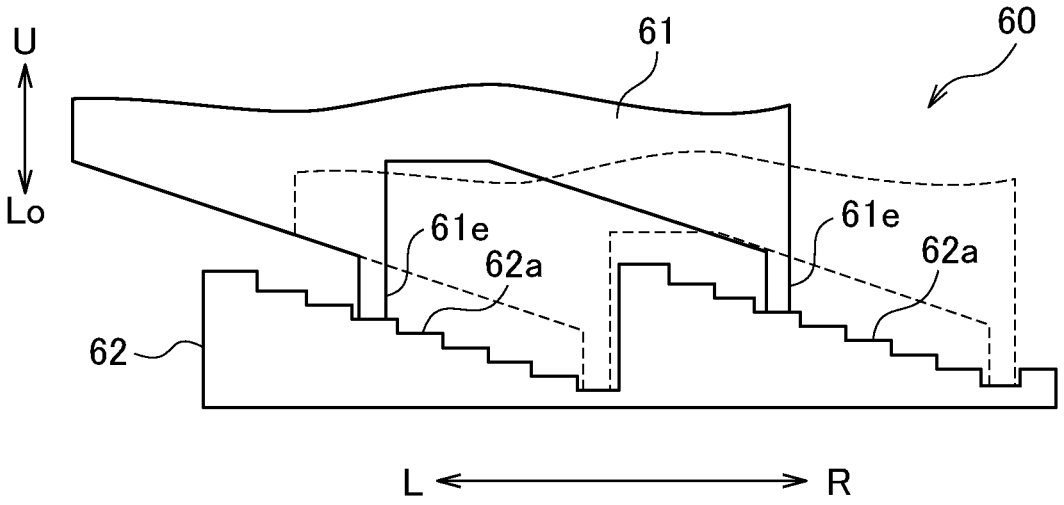
FIG. 8 is an enlarged view showing a main part of the first adjustment mechanism shown in FIG. 7.

As shown in FIG. 8, in the adjusting member 62, a plurality of step portions 62*a* with which a lower end of the holding member 61 comes into contact are provided. In this example, the step portions 62*a* are divided into two left and right groups, the groups are configured similarly with the same number of the step portions 62*a*, positions in the upward and downward directions (the conveying direction of the sheet) of the step portions 62*a* in each group are different stepwise. The positions of the step portions 62*a* in each group are stepwisely increased from a right side to a left side.

On the other hand, in the lower end of the holding member 61, a pair of left and right contact portions 61*e* are provided so as to come into contact with respective ones of the step portions 62*a* in two groups provided in the adjusting member 62.

The first adjustment mechanism 60 configured as described above moves the adjusting member 62 in the left and right directions (an arranged direction of the plurality of step portions 62*a*) to change contact positions of the contact portions 61*e* with respect to the plurality of step portions 62*a*, and thereby, adjusts the movement position of the holding member 61 in the upward and downward directions. When the holding member 61 holding the front guide protrusion part 28A of the fixing unit 20 is moved in the upward and downward directions, a front side of the fixing unit 20 is moved in the upward and downward directions and angle adjustment of the fixing unit 20 is carried out. After the angle adjustment of the fixing unit 20, when the holding member 61 is fixedly attached to the front supporting plate 51 by fastening the screws 59 (FIG. 7), an angle of the fixing unit 20 is maintained by an angle after adjustment.

Figure 9:
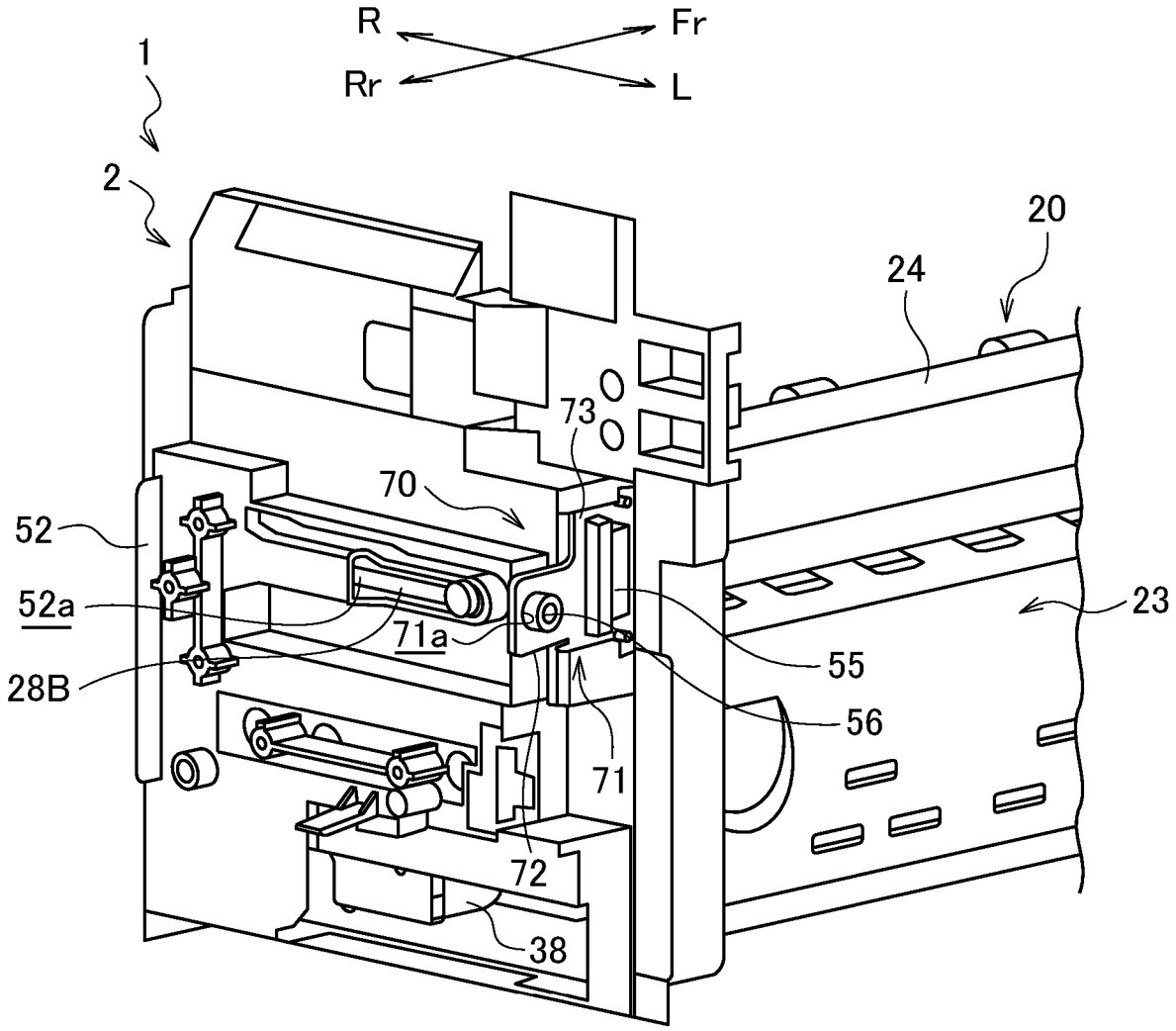
FIG. 9 is a partly perspective view showing a second adjustment mechanism and a connection part at a main body side and their peripherals of the image forming apparatus shown in FIG. 1.

As shown in FIGS. 6 and 9, in the rear supporting plate 52, a guide gap portion 52*a* receiving and holding the rear guide protrusion part 28B (refer to FIG. 3) of the fixing unit 20, a main body side drawer terminal 55 (a main body side connection part) electrically connected with the unit side drawer terminal 37 (refer to FIG. 4), and a second adjustment mechanism 70 used for adjusting a position of the main body side drawer terminal 55 by interlocking with the angle adjustment of the fixing unit 20 by the first adjustment mechanism 60 (refer to FIG. 7). The guide gap portion 52*a* is extended in the left and right directions. The fixing unit 20 is turned in the upward and downward directions around the rear guide protrusion part 28B held by the guide gap portion 52*a* as a supporting point when the angle adjustment. In the rear supporting plate 52, a columnar supporting axis part 56 is provided and protruded in the vicinity of a left side of the guide gap portion 52*a*.

The second adjustment mechanism 70 includes a movable member 71. The movable member 71 includes an arm part 72 having an axis hole 71*a* elongated in the forward and backward directions, and a terminal attachment part 73 widened from the arm part 72 in the upward and downward directions. In the axis hole 71*a*, the supporting axis part 56 of the rear supporting plate 52 is inserted. The movable member 71 is turnable in the upward and downward directions around the supporting axis part 56, and movable in the forward and backward directions between a position when the supporting axis part 56 comes into contact with a front end of the axis hole 71*a* and a position when the supporting axis part 56 comes into contact with a rear end of the axis hole 71*a*. In the terminal attachment part 73 of the movable member 71, the main body side drawer terminal 55 is provided. That is, in this example, the main body side drawer terminal 55 is provided in the rear supporting plate 52 so as to be movable in the upward and downward directions and in the forward and backward directions by the movable member 71.

In accordance with the second adjustment mechanism 70 configured as described above, in a condition that the unit side drawer terminal 37 and the main body side drawer terminal 55 are connected with each other, when the angle adjustment of the fixing unit 20 is carried out by moving a front end side of the fixing unit 20 in the upward and downward directions, the main body side drawer terminal 55 is moved together with the unit side drawer terminal 37 displacing in the upward and downward directions according to the angle adjustment of the fixing unit 20. Thereby, the angle adjustment of the fixing unit 20 and position adjustment of the main body side drawer terminal 55 in the upward and downward directions are simultaneously carried out. Moreover, when the unit side drawer terminal 37 is displaced in the forward and backward directions according to the angle adjustment of the fixing unit 20, the main body side drawer terminal 55 is moved together with the unit side drawer terminal 37. Thereby, the angle adjustment of the fixing unit 20 and position adjustment of the main body side drawer terminal 55 in the forward and backward directions are simultaneously carried out.

Figure 10:
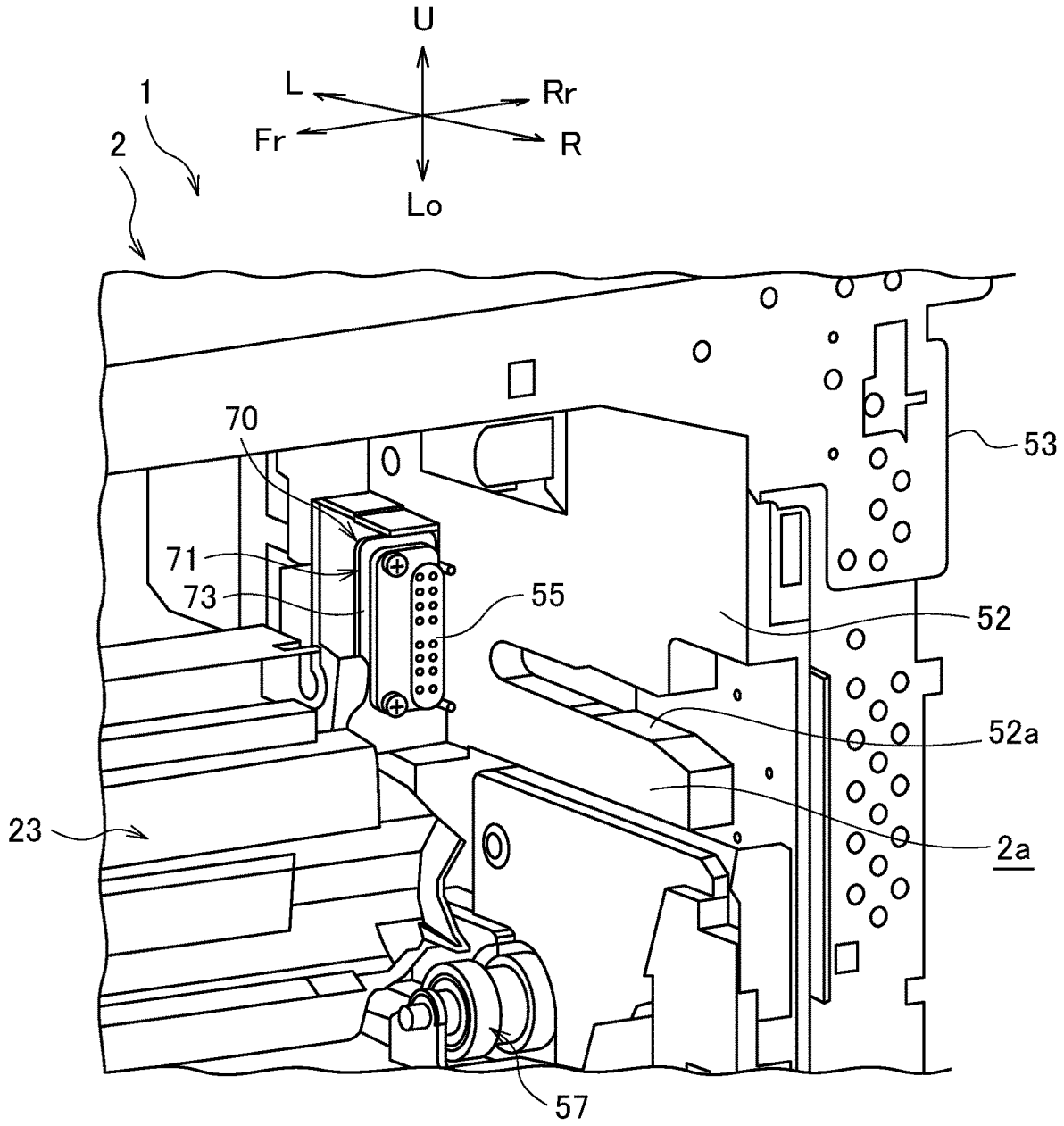
FIG. 10 is a partly perspective view showing a power transmission mechanism at the main body side and its peripherals of the image forming apparatus shown in FIG. 1.

As shown in FIG. 10, in a rear side of the unit housing chamber 2*a*, i.e. the side of the supporting point of the angle adjustment of the fixing unit 20, a main body side drive gear 57 connected with the unit side drive gear is provided. The main body side drive gear 57 is driven and rotated by power from a drive source not shown in the apparatus main body 2. By connecting the unit side drive gear 38 and the main body side drive gear 57, the power is transmitted to a rotating shaft of the pressuring roller 22 (refer to FIG. 2). The unit side drive gear 38 and the main body side drive gear 57 compose a power transmission mechanism.

Thus, since the power transmission mechanism transmitting the power from the apparatus main body 2 to the fixing unit 20 is arranged at the side of the supporting point of the angle adjustment of the fixing unit 20, variation of an angle of the unit side drive gear 38 according to the angle adjustment of the fixing unit 20 is restrained to be small.

In accordance with the embodiment configured as described above, the main body side drawer terminal 55 is arranged at the side of the supporting point of the angle adjustment of the fixing unit 20 by the first adjustment mechanism 60, displacement of the unit side drawer terminal 37 according to the angle adjustment of the fixing unit 20 can be restrained to be small. Thereby, a large scale for the position adjustment of the main body side drawer terminal 55 can be made unnecessary and adjustment work with respect to the angle adjustment of the fixing unit 20 can be simplified.

Moreover, in accordance with the embodiment, the first adjustment mechanism 60 can be actualized by simple structure composed of the holding member 61 and the adjusting member 62.

In addition, in accordance with the embodiment, the angle adjustment of the fixing unit 20 can be carried out by simple operation of moving the adjusting member 62 to the holding member 61 in the arranged direction of the plurality of step portions 62*a*.

Further, in accordance with the embodiment, by providing the second adjustment mechanism 70, since the position of the main body side drawer terminal 55 in the upward and downward directions and the forward and backward directions can be adjusted according to the angle adjustment of the fixing unit 20 by the first adjustment mechanism 60, the adjustment work with respect to the angle adjustment of the fixing unit 20 can be simplified further.

Furthermore, in accordance with the embodiment, by providing the main body side drawer terminal 55 in the movable member 71 being turnable in the conveying direction of the sheet (the upward and downward directions) and being movable in a longitudinal direction of the fixing unit 20 (the forward and backward directions), the second adjustment mechanism 70 can be actualized by simple structure Moreover, in accordance with the embodiment, since the variation of the angle of the unit side drive gear 38 according to the angle adjustment of the fixing unit 20 is restrained to be small, meshing failure of the unit side drive gear 38 and the main body side drive gear 57 can be prevented.

Incidentally, the present disclosure is not restricted by the above-described embodiment, and it may be modified or improved appropriately. For example, although the above-described embodiment was described about the image forming apparatus 1 including the fixing device 11 of a so-called belt type, the present disclosure may be effectively applied in the image forming apparatus 1 including a fixing device of a so-called roller type.

Although, in the second adjustment mechanism 70 in the above-described embodiment, the plurality of step portions 62*a* are provided in the adjusting member 62 and the contact portions 61*e* are provided in the holding member 61, the adjusting member 62 may include such contact portions 61*e* and the holding member 61 may include such plurality of step portions 62*a*.

Although the image forming apparatus 1 in the above-described embodiment is the multifunction peripheral, the present disclosure may be applied to a printer, a copying machine, a facsimile or the like.

Although the present disclosure was described about the specific embodiment, the present disclosure is not restricted by the above-described embodiment. It is to be appreciated that those skilled in the art can change or modify the embodiment without departing from the scope and spirit of the present disclosure.

The invention claimed is:

1. An image forming apparatus comprising:

a fixing unit fixing a toner image on a sheet while conveying the sheet; and an apparatus main body in which the fixing unit is removably attached, wherein the fixing unit includes a unit side connection part, the apparatus main body includes:

a main body side connection part electrically connected with the unit side connection part; and a first adjustment mechanism used for adjusting an angle of the fixing unit with respect to the apparatus main body, the main body side connection part is arranged at a side of a supporting point of angle adjustment of the fixing unit by the first adjustment mechanism.

2. The image forming apparatus according to claim wherein the first adjustment mechanism includes:

a holding member holding an opposite end to a side of the supporting point of the fixing unit and being movable in a conveying direction of the sheet; and an adjusting member used for adjusting a movement position of the holding member.

3. The image forming apparatus according to claim 2, wherein one of the holding member and the adjusting member is provided with a plurality of step portions at stepwise different positions in the conveying direction of the sheet, and the other is provided with a contact portion being able to come into contact with a part of the plurality of step portions, the adjusting member is movable in an arranged direction of the plurality of step portions with respect to the holding member, when a movement position of the adjusting member is adjusted to vary a contact position of the contact portion with respect to the plurality of step portions, the movement position of the holding member is adjusted.

4. The image forming apparatus according to claim 1, further comprising:

a second adjustment mechanism used for adjusting a position of the main body side connection part by interlocking with the angle adjustment of the fixing unit by the first adjustment mechanism.

5. The image forming apparatus according to claim 4, wherein the second adjustment mechanism includes:

a movable member in which the main body side connection part is provided, the movable member is turnable in a conveying direction of the sheet and is movable in a longitudinal direction of the fixing unit.

6. The image forming apparatus according to claim 1, wherein a power transmission mechanism transmitting power from the apparatus main body to the fixing unit is arranged at the side of the supporting point of the angle adjustment of the fixing unit.

7. The image forming apparatus according to claim 1, wherein the fixing unit includes front and rear guide protrusion parts, the apparatus main body includes front and rear supporting plates supporting the guide protrusion parts, the fixing unit is turned in upward and downward directions by the first adjustment mechanism around the rear guide protrusion part supported by the rear supporting plate as the supporting point, and thereby, the angle adjustment of the fixing unit is carried out.

8. The image forming apparatus according to claim 7, wherein in a condition that the unit side connection part and the main body side connection part are connected with each other, when the angle adjustment of the fixing unit is carried out by moving a front end side of the fixing unit in the upward and downward directions, the main body side connection part is moved together with the unit side connection part displacing in upward and downward directions according to the angle adjustment of the fixing unit, and the main body side connection part is moved together with the unit side connection part displaced in forward and backward directions according to the angle adjustment of the fixing unit.

* * * * *